US005662411A

United States Patent [19]

Haslam et al.

[11] Patent Number: 5,662,411

[45] Date of Patent: Sep. 2, 1997

[54] MOTION ACTIVATED LIGHT FIXTURE WITH FIXED SENSOR

[75] Inventors: Gary M. Haslam, Graham; Andrew J. Parker, Chapel Hill, both of N.C.

[73] Assignee: Regent Lighting Corporation, Burlington, N.C.

[21] Appl. No.: 406,732

[22] Filed: Mar. 20, 1995

[51] Int. Cl.[6] ..... F21S 1/02

[52] U.S. Cl. ..... 362/276; 362/394; 362/802; 362/147; 340/567; 359/741; 359/742; 250/353; 250/DIG. 1

[58] Field of Search ..... 362/276, 147, 362/287, 421, 427, 802, 394, 249; 340/567; 359/741, 742; 250/353, DIG. 1

[56] References Cited

U.S. PATENT DOCUMENTS

| | | | |
|---|---|---|---|
| D. 315,424 | 3/1991 | Claytor | D26/122 |
| 3,958,118 | 5/1976 | Schwarz | 250/221 |
| 3,988,726 | 10/1976 | Reiss et al. | 340/258 D |
| 4,752,769 | 6/1988 | Knaup et al. | 340/567 |
| 4,787,722 | 11/1988 | Claytor | 350/452 |
| 5,258,899 | 11/1993 | Chen | 362/802 |
| 5,282,118 | 1/1994 | Lee | 362/276 |
| 5,308,985 | 5/1994 | Lee | 250/353 |
| 5,311,024 | 5/1994 | Marman et al. | 250/353 |
| 5,335,159 | 8/1994 | Chen et al. | 362/147 |
| 5,381,323 | 1/1995 | Osteen et al. | 340/567 |

OTHER PUBLICATIONS

Advertisement "Automatic Two Level Lighting", about Jun. 1994.

Advertisement "Motion Activated 300 Watt Quartz Halogen Floodlight", about Jun. 1992.

Advertisement "Motion Activated Twin Floodlight Kit", about Dec. 1993.

*Primary Examiner*—James C. Yeung
*Assistant Examiner*—Thomas M. Sember
*Attorney, Agent, or Firm*—Olive & Olive, P.A.

[57] ABSTRACT

A motion activated light fixture has a housing comprised of a canopy, a base formed integral with the canopy and at least one illumination source mounted on the housing. The housing has a centrally located mounting hole which enables the base and canopy to be rotated 360 degrees around the mounting hole prior to being mounted on a selected vertical or horizontal surface. The sensor component mounts on an outer surface of the housing and includes a lens plate in which plural lens segments are formed in a plurality of rows so as to provide a substantially wide angle of view of up to 180 degrees and which view can be variably positioned utilizing the referred to mounting hole configuration.

13 Claims, 7 Drawing Sheets

MOTION ACTIVATED LIGHT FIXTURE WITH FIXED SENSOR

BACKGROUND OF THE INVENTION

1. Field of the Invention

This invention relates to motion activated lights.

2. Description of the Related Art

Passive infrared (PIR) sensors have been developed and utilized in various devices to sense the approach or motion of a person. Infrared radiation is the physical means of detection, there being a known relationship between the wavelength of the strongest infrared radiation and the temperature of the body emitting it. Thus, the body of a human, as well as that of some other animals, radiates the strongest infrared radiation between 9 μm and 10 μm. Infrared radiation can be detected due to the "pyroelectric effect", which is due to the generation of a surface electric charge on certain dielectric crystalline materials when exposed to infrared radiation, which differs from the "natural charge" at thermal equilibrium that is present due to spontaneous polarization. The current which flows when there is a temperature change and resultant change in surface charge can be measured by means known in the art, for example, by connecting a high impedance resistor between the electrodes of both crystal surfaces and reading the voltage drop.

An improvement in infrared detection devices occurred when the optical system was developed to include a number of facets in an associated reflector and/or one or more lenses, which were oriented so that radiation originating in the particular ranges of angular scan of the lenses was sequentially directed to a group of thermal detectors (See for example, U.S. Pat. No. 3,958,118 of Schwartz).

Motion activated light fixtures now generally utilize infrared sensors, together with an optical collecting and focusing means such as a system of Fresnel lenses. The aggregate of the individual fields of view of the multiple Fresnel lenses defines the overall field of view of the device. Generally, the lens plates to which the Fresnel lenses are mounted are curved sections from a cylindrical surface, with the Fresnel lenses being mounted in parallel rows. Examples include various fixtures sold by Regent Lighting Corporation (e.g., Model Numbers MS35, MS30 and MS80). Fresnel lenses, each of which is made of a surface of stepped concentric circles, collect radiation from a moving object and direct the energy to a detector. The detector can be a thermistor in which resistance changes with a change in the energy level, or more generally, a pyrosensor which generates a voltage or alters a current passing through it. Such fixtures also comprise one or more signal amplifiers and a control circuit.

Current motion activated light fixtures, particularly those with two bulbs, typically have a junction box coverplate to which the two light bulbs are mounted as shown in FIG. 1. Mounted between the two light bulbs is a protruding external sensor S which is adjustable in position so that it can be aimed in various directions to detect motion when the fixture is mounted on the eaves or ceiling or on a wall. Because this external sensor protrudes from the fixture, it is subject to damage due to impact of flying or passing objects. Also, it often detracts from the appearance of the fixture. The very visible sensor also gives notice to an intruder that there is a motion detector attached to the light fixture.

Light fixtures with integral motion detectors which do not protrude have been designed so that the lens is placed to avoid viewing interference from other parts of the fixture. See for example, the wall light fixture of Lee (U.S. Pat. No. 5,282,118). Because of the fixed position of the detector of such fixtures, the angular range of detection of this fixture is limited.

It is therefore an object of this invention to provide a motion activated light fixture which has a fixed sensor head which does not protrude from the fixture but is integrated into the junction box coverplate.

It is a further object of the invention to provide a motion activated light fixture which allows detection range flexibility whether mounted to vertical or horizontal surfaces without having a movable external sensor head.

Other objects and advantages will be more fully apparent from the following disclosure and appended claims.

SUMMARY OF THE INVENTION

The motion activated light fixture of the invention comprises a housing, at least one illumination source protruding from said housing, and a motion sensor component mounted on said housing, preferably so that said motion sensor may be removed from the housing or interchanged with another motion sensor if desired. The motion sensor component comprises a section of a cylindrical plastic sheet and a plurality of lens segments formed on said plastic, sheet in a plurality of rows.

Other aspects and features of the invention will be more fully apparent from the following disclosure and appended claims.

DETAILED DESCRIPTION OF THE INVENTION AND PREFERRED EMBODIMENTS THEREOF

The present invention comprises a motion activated light fixture 20 which in its broadest conception has at least one, and preferably two, illumination sources and at least one motion sensor component 24, which are mounted on a junction box canopy (termed housing 26 herein) which covers the electrical components (not shown, and not unique to this invention) of the light fixture 20.

In the discussion below of the preferred embodiments, specific angles, numbers of lens segments, numbers of detection zones and levels, and the like are provided to aid in understanding the invention; however, variations in these are clearly within the scope of the invention.

The illumination sources may be any type of bulb or light emitting component as is known in the art, such as those used on prior motion activated light fixtures. Thus, two floodlights, each having a wattage of 150 watts, as is used in many current fixtures, may be placed in lamp sockets 22, shown in FIGS. 2–4. Preferably, the angle of aim of the lights in sockets 22 is individually adjustable so that the light is aimed into the area which the person wishes to be illuminated if motion is detected, for example, a doorway or hallway. The figures do not show the sockets 22 at angles adjusted for a particular actual use.

A very important characteristic of the invention is that each light fixture 20 of the invention is mountable on either a vertical or horizontal surface for the preferred wide-angle detection of motion in a selected area of view without adjustment of the position of a sensor head. The terms "motion detection", "motion sensor" or "activated by motion" and the like refer herein to the detection of an infrared radiation source in the field of view of the light fixture, which is associated with an infrared radiation increase in the field of view detectable by the fixture. As used herein, the terms "view" and "see" and variations and synonyms thereof are used to describe the area and scope of detection of movement by motion activated light fixtures. The term "zone" is used to describe the solid (3-dimensional) angle extending out into space from fixture 20 where fixture 20 can "see" movement, and which is defined by the areas in which movement is detectable by the lens segments.

Figure 1:
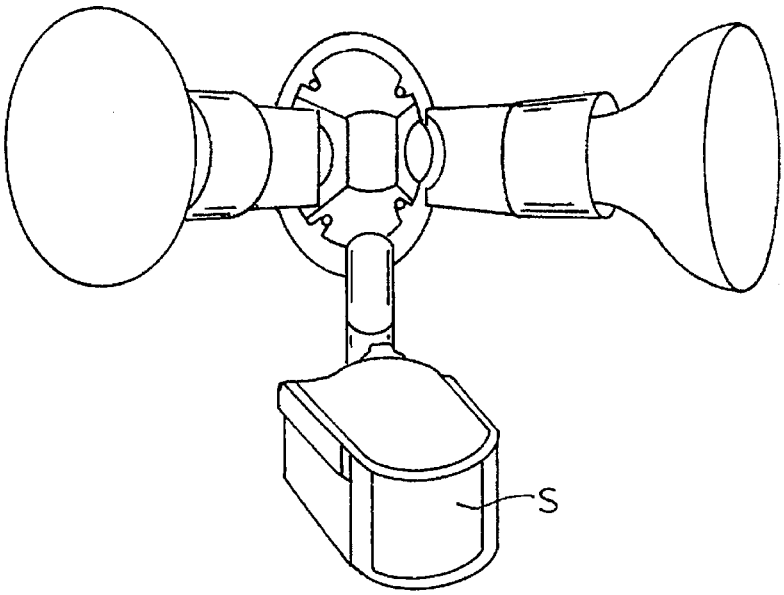
PRIOR ART FIG. 1
FIG. 1 is a perspective view of prior art motion activated light fixture.
Figure 2:
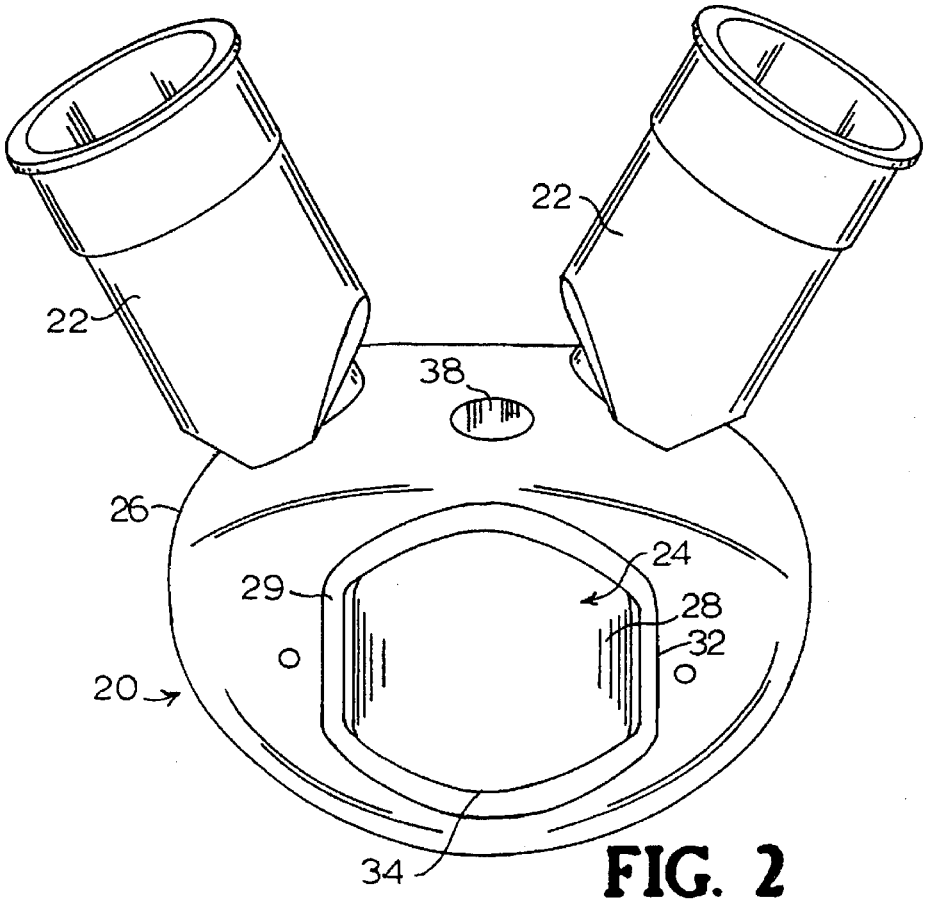
FIG. 2 is a perspective view of a motion activated light fixture, viewed from below, when mounted on a vertical surface, according to a first embodiment of the invention herein having a single motion sensor component.

In one preferred embodiment, motion activated light fixture 20 comprises, but is not limited to, an all-plastic twin par light fixture with at least one motion sensor component 24 integrated into housing 26 (FIG. 2). Motion sensor component 24 is fixed in housing 26 and is not movable or rotatable when mounted in housing 26.

Figure 6A:
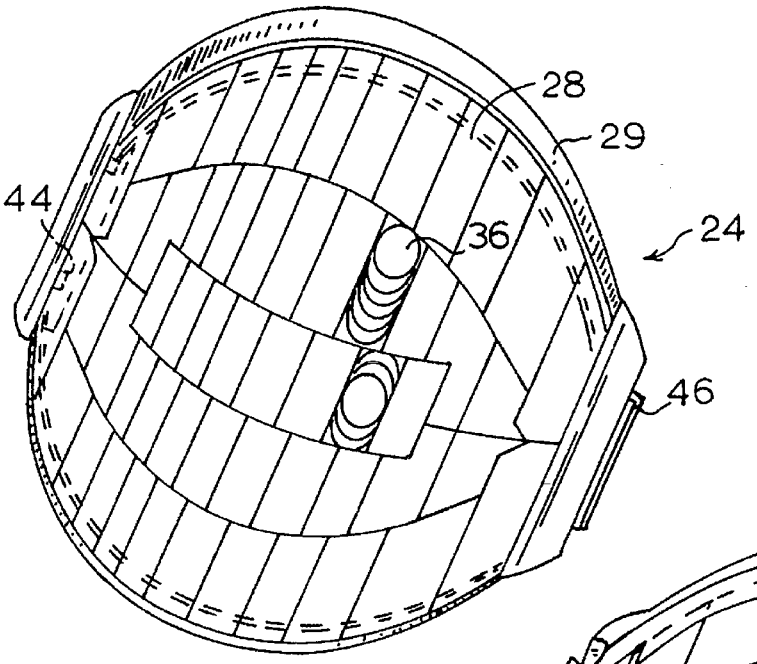
FIG. 6A is a perspective view of the front (outside) of a motion sensor component which may be used in the invention.
Figure 6B:
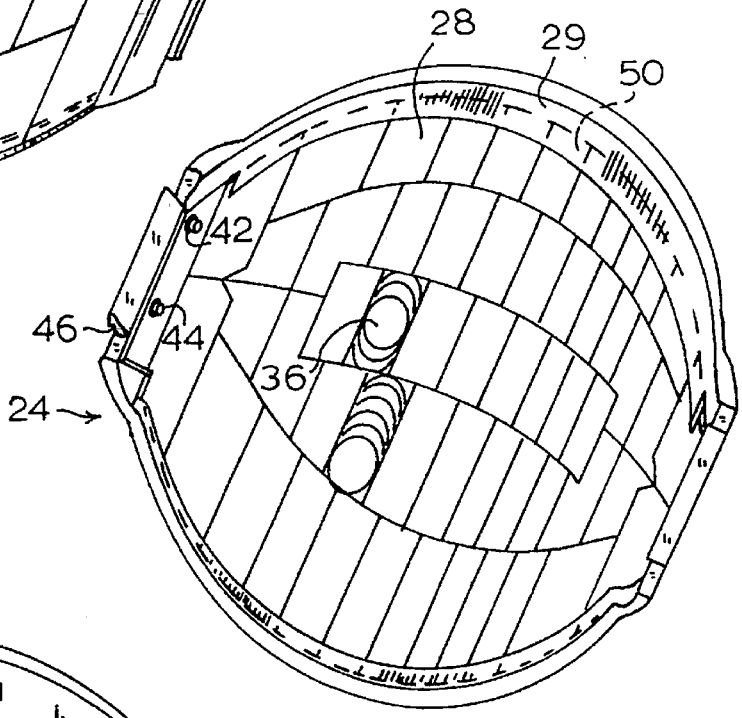
FIG. 6B is a perspective view of the back (inside) of the motion sensor component of FIG. 6A.
Figure 12:
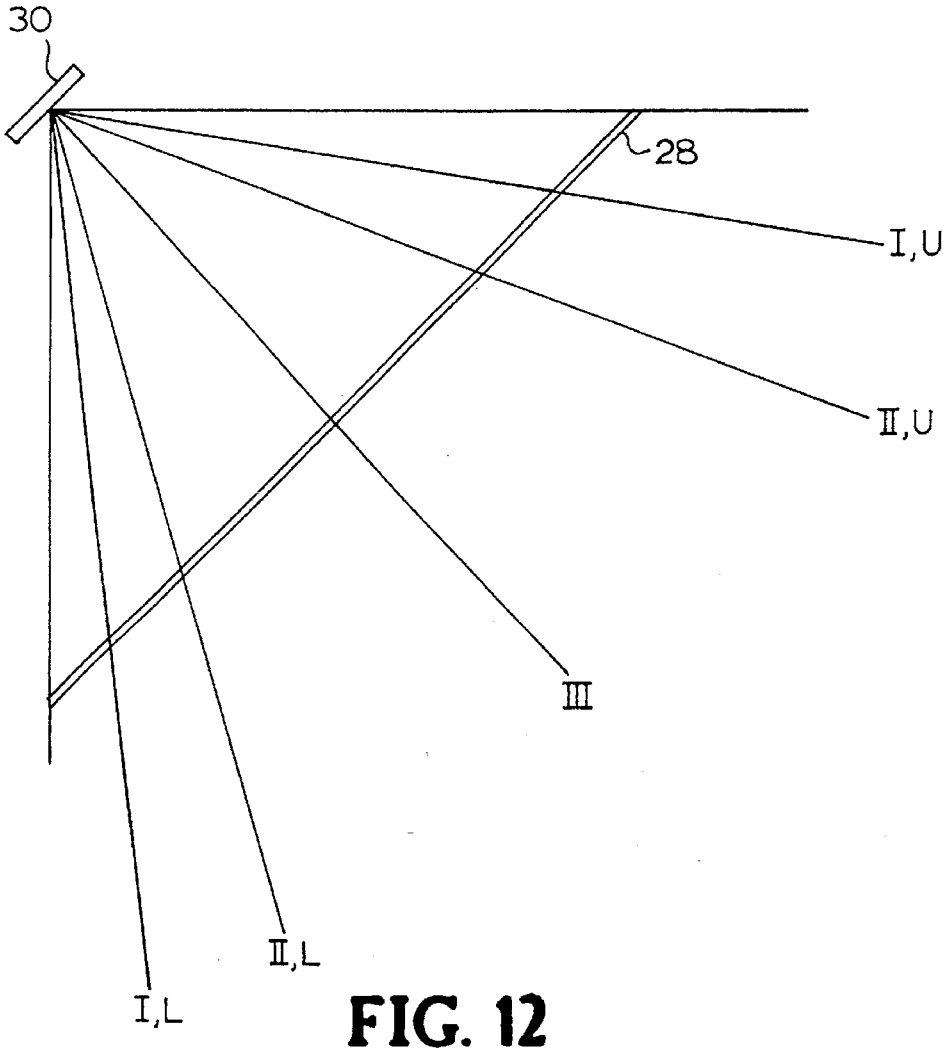
FIG. 12 is a schematic representation of a detector and lens plate orientation showing the direction of primary focus of infrared radiation from the upper (U) and lower (L) rows of the first (I) and second (II) levels, and from the single row at the third level (III) relative to the plane of the lens.

In the preferred embodiment, motion sensor component 24 comprises an external wide-angle (up to about 180°) lens plate 28. In practice, an angle of about 160°–170° is sufficient for a fixture placed on a flat surface. Lens plate 28 is mounted in a holder 29, which is in turn mounted over a concavity in fixture 20, external to a standard detector 30 (FIG. 12) as is known in the art. A perspective view of motion sensor component 24 having lens plate 28 attached thereto is shown in FIGS. 6A and 6B.

Although light fixtures made according to the invention preferably contain a wide-angle lens plate 28 to maximize the usefulness of the light fixtures, the invention also may include use of lens plates having a more restricted, intensively covered field of view if desired for a particular use.

Figure 7:
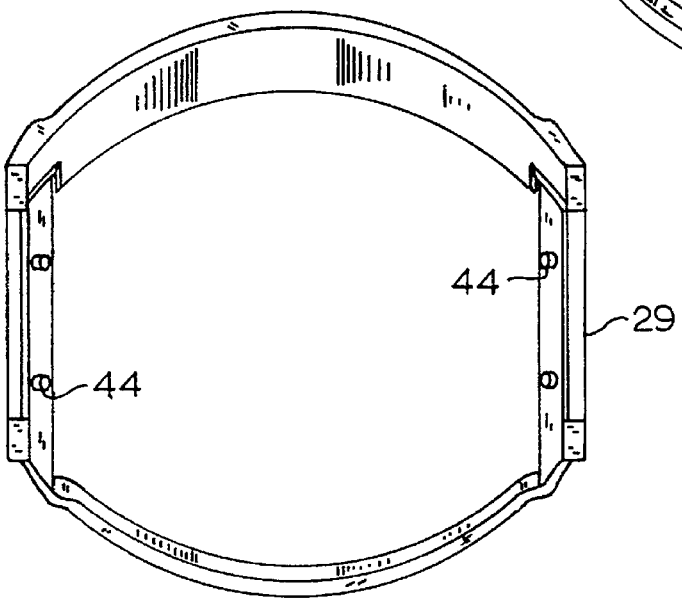
FIG. 7 is a back plan view of the lens plate holder of the invention.

Holder 29 is shown separately in FIG. 7. The means of mounting lens plate 28 in holder 29 is preferably simple, for example, by placing holes 42 formed near the sides of lens plate 28 over prongs 44 (FIG. 7) which are along the sides of holder 29 (see FIG. 6B). The attachment may be made permanent by hot-melt or ultrasonic processes known in the art, or by reshaping the prongs so that they cannot be withdrawn from the holes. In addition, there may be a lip 50 on the inside of one or both of the longer curved edge(s) of holder 29 to keep lens plate 28 in place in holder 29. Alternatively, lens plate 28 may be molded to be one piece with holder 29 or may be attached thereto by any permanent or releasable means known in the art.

To the extent that motion sensor component 24 is to be aimed in a particular direction, light fixture 20 can be physically positioned during installation so that the sensor component 24 can detect motion in that direction. This particularly applies to horizontal mounting situations. Mounting is preferably by means of a center mounting hole 38 (shown in FIG. 3A) allowing the fixture to be rotated a full 360° for positioning before mounting and to be mounted on a vertical or horizontal surface, for example, on a ceiling or under the eaves. This is particularly useful for a horizontal mounting so that the entire fixture can be rotated to optimize the field of view covered by the lens.

Because of the unique structure of the lens plate 28 which provides a wide angle of view, simply mounting light fixture 20 in a chosen position on a wall or under the eaves of a building is generally sufficient for allowing as good a detection around the fixture as standard motion fixtures with protruding sensor heads.

Figure 4:
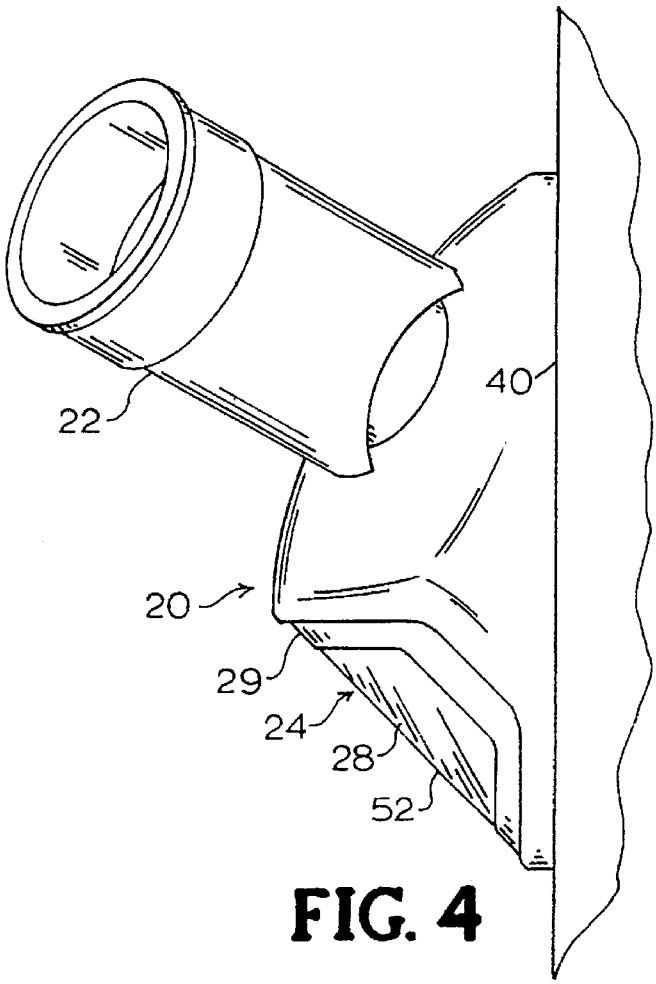
FIG. 4 is an elevational side view of the fixture of FIG. 2, which is mounted on a vertical surface.

In the preferred embodiments of the invention shown in the figures, the face 52 of lens plate 28, when viewed from the side of motion sensor component 24, is angled at 45° to base 40 of housing 26 of light fixture 20 as shown in FIG. 4. This angle optimizes the usefulness of the invention's feature of being mountable either on a horizontal or vertical surface without loss of viewing area. It is within the scope of the invention, however, to have the angle of face 52 of lens plate 28 to housing 26 be at other angles than 45°. As the angle becomes substantially different from 45°, there is a concomitant loss of the versatility of the fixture for being usable for wide-angle detection in each of the two mounting positions, unless corresponding changes are made in the arrangement and location of the Fresnel lenses on lens plate 28 (see discussion below). If loss of versatility is not a problem, the angle can be any angle that allows placement of the Fresnel lenses on the lens plate so that the view by the fixture is the area desired to be viewed when the fixture is in the desired mounting position. It is also within the scope of the invention to structure the lens plate to be angled at two or more angles. For example, the lens plate could have half of the lens plate at one angle and half of the lens plate at a second angle, or could have a convex or concave area located on the lens plate.

The portion of housing 26 around lens plate 28 is slightly recessed on the sides of lens plate 28 as shown in FIG. 2 so that detection to the sides of lens plate 28 is not blocked by housing 26.

In the first preferred embodiment of the invention, there is a single lens plate 28 (a single motion sensor component), which is preferably generally rectangular with two parallel short sides 32, and with the two opposite longer sides 34 being outwardly rounded (FIG. 2).

Figure 3A:
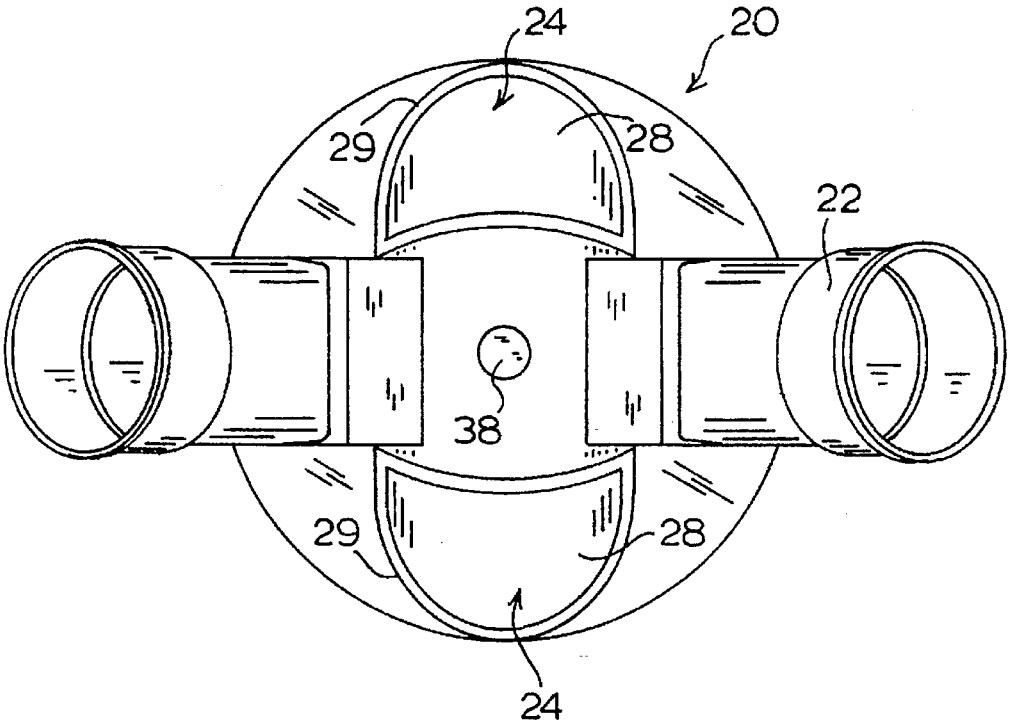
FIG. 3A is a lower plan view of a motion activated light fixture, according to a second embodiment of the invention herein having two motion sensor components, as viewed from beneath the fixture mounted on a horizontal surface.
Figure 3B:
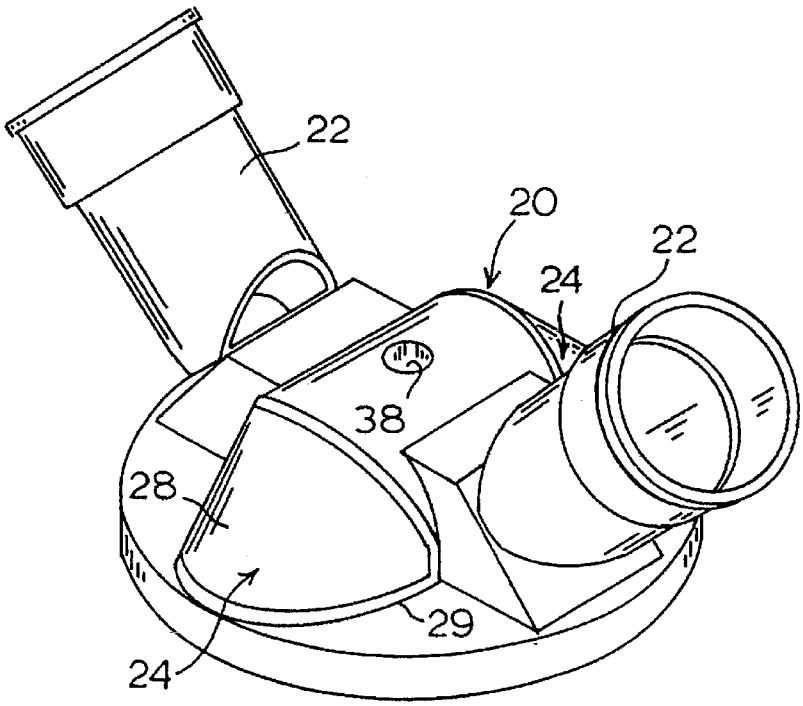
FIG. 3B is a side perspective view of the fixture of FIG. 3A.

In the second preferred embodiment, light fixture 20 has two lens plates 28, one mounted on each side of housing 26 as shown in FIGS. 3A and 3B, with a corresponding detector positioned interiorly of each lens plate 28. Each lens plate 28 in this embodiment preferably has the same extent of wide-angle (up to about 180°), but has an oppositely aimed field of view with respect to housing 26, and therefore, in the preferred embodiment where the view of each is about 180° has about a 360° field of view. The fixture of the invention with either one or two motion sensor components covers at one time the same field of detection as, or substantially greater than, is currently available with rotatable sensor heads.

Figure 5:
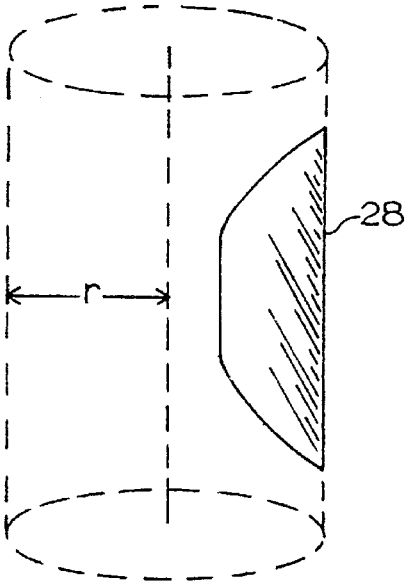
FIG. 5 is a schematic representation showing how the exterior lens plate is in the form of a portion of a cylindrical surface. The dotted lines are shown for illustrative purposes and form no part of the invention.

The form of lens plate 28 when mounted in holder 29 is as if it were made from a section of a cylindrical plastic sheet having a radius r (shown schematically in FIG. 5). When mounted on light fixture 20, the external surface of lens plate 28 is less than the distance r from detector 30 to enable the fixture to be more compact and less rounded.

Figure 14A:
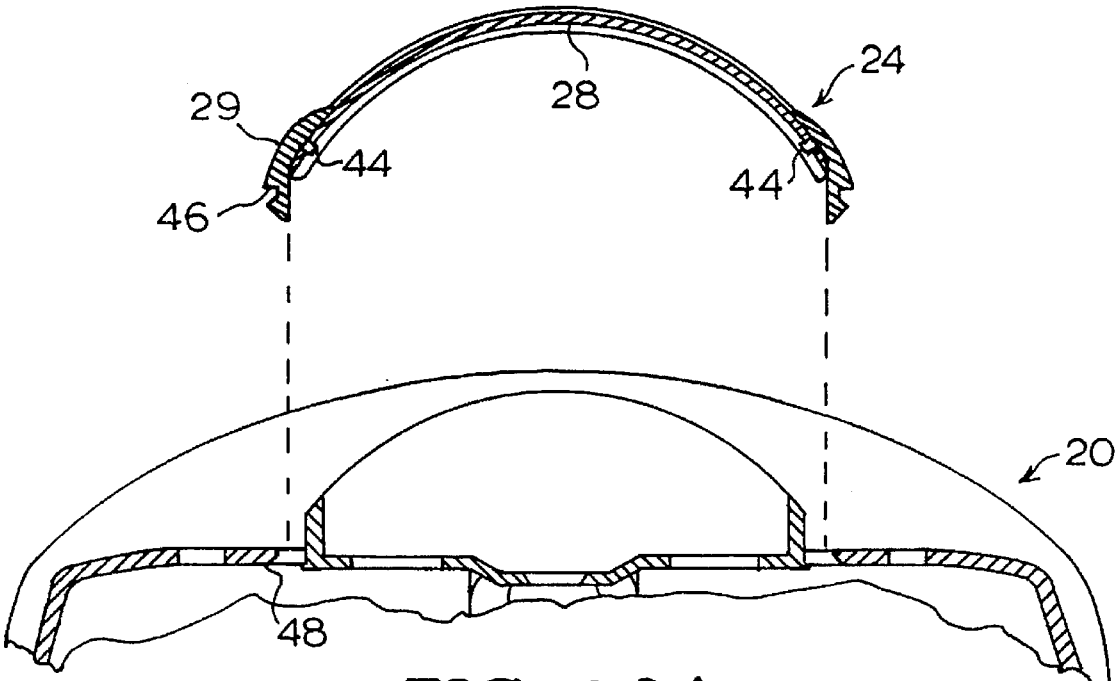
FIG. 14A is a cross-sectional view of a lens plate mounted in a holder showing where the holder is to be placed on a fixture.
Figure 14B:
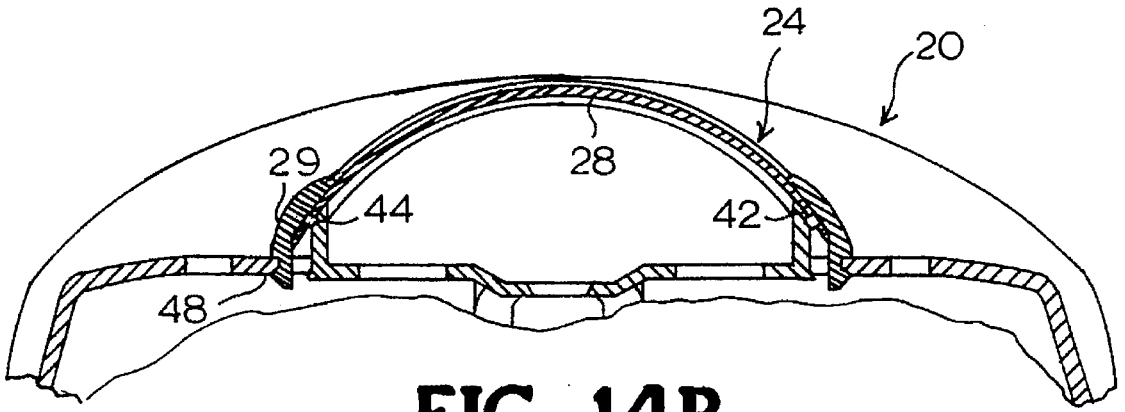
FIG. 14B is a cross-sectional view of a lens plate and holder mounted on the fixture.

As shown in FIGS. 14A and 14B, holder 29 is preferably releasably insertable into a concavity in fixture 20 by means of a slot 46 on each shorter edge of holder 29, each of which fits by snapping over an edge 48 surrounding the concavity. Removal of holder 29 from fixture 20 allows inspection of the detector for maintenance, as well as enabling replacement of lens plate 28 due to damage or other problems. During installation, holder 29 may be removed to allow access to switches which are present behind the lens plate.

Figure 8:
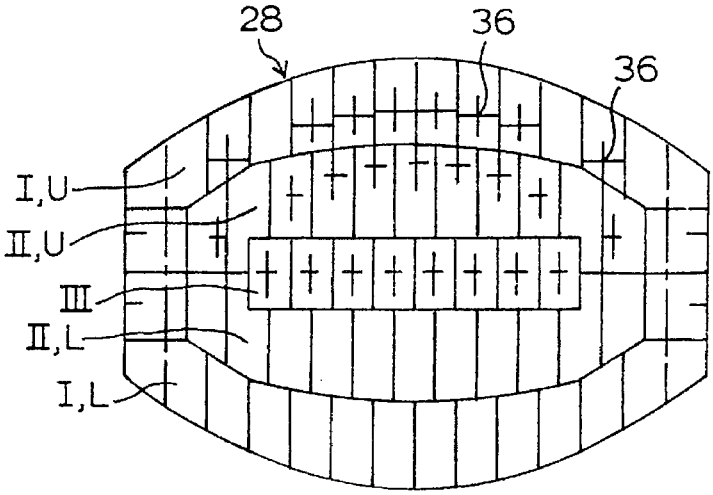
FIG. 8 is a schematic view of the area of a lens plate having Fresnel lenses thereon according to the invention showing the preferred lens segment orientation. Lines drawn on the lens plate show the areas in which the Fresnel lenses are placed in this embodiment, with the location of the center of the Fresnel lenses being marked with a "+" at the center and top half of the lens plate.

Motion sensor component 24 is structured to allow detection of infrared radiation through placement of a plurality of lenses 36 ("lens segments") which are formed on lens plate 28 by means known in the art for forming Fresnel lenses. One preferred arrangement is shown in FIG. 8. In this Figure the Fresnel lenses are positioned so that each is centered on one of the "+" markings in the Figure. An example of the appearance and location of representative lens segments 36 on lens plate 28 is shown in FIGS. 6A and 6B. Although in the preferred embodiment the arrangement of the lower lens segments on lens plate 28 is a mirror image of the upper arrangement that is shown in FIG. 8, other arrangements as discussed below may be devised for particular circumstances.

The lens segments 36 are arranged on lens plate 28 to allow the desired wide angle of view. Several factors determine the view, including where the lens is placed relative to the sensor location and relative to the focal points on the lens plate. Preferably, on a fixture having two motion sensors (the second embodiment) there is the same lens segment arrangement on each of the two motion sensor components 24, so that the views seen by the two lenses on a fixture are symmetrical. Alternatively, the two lens plates 28 in this embodiment may have a different orientation of the lens segments for particular viewing requirements so that the view seen by each motion sensor component is not symmetrical with respect to the view seen by the other lens. The removability from fixture 20 of the motion sensor components 24, discussed herein, allows a particular fixture 20 to be adapted for a particular viewing situation or location by insertion of a motion sensor component having the desired view.

Lens segments 36 may be arranged any way on lens plate 28 to obtain the desired zone of view. As shown in FIG. 8, one of the possible patterns of arrangement of the lens segments 36 on each lens plate 28 comprises five linear detection zones. Each detection zone in this arrangement is made of one row of lens segments 36. Thus, in the this embodiment there are five rows of lens segments, arranged so that there is a generally straight central row, halfway between the two outer longer edges of lens plate 28 (termed third level or III herein), two gently curved rows of lens segments (termed second level or II herein), one of which is on each side of the central row, and two more curved rows of outer segments (termed first level or I herein) as shown in FIG. 8. When light fixture 20 having this arrangement of lens segments is mounted on a horizontal or vertical surface, there is therefore a row of first level lens segments and a row of second level lens segments which are physically above the third level (termed "upper" or U), and a first level row and a second level row that are mounted below the third level (termed "lower" or L). The lens segments in the respective levels are mounted on the lens plate 28 so that an object in a particular location will be detected by that segment. Each Fresnel lens segment is made using technology known by those of skill in the art, and is positioned on the lens plate using standard calculation techniques so that infrared radiation from the desired area of view impinging on the particular Fresnel lens portion is bent so that it is detectable by detector 30.

Figure 9:
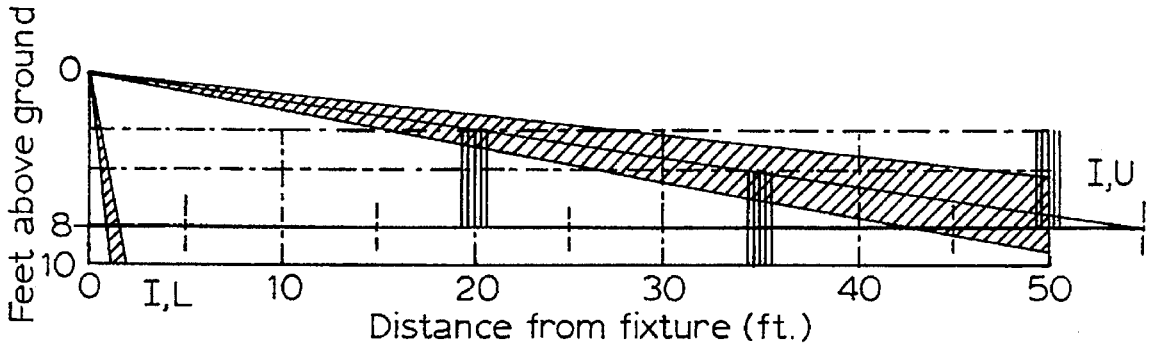
FIG. 9 is a schematic diagram of a possible vertical detection pattern of the upper (U) and lower (L) zones of a first level (I) of lens segments.
Figure 10:
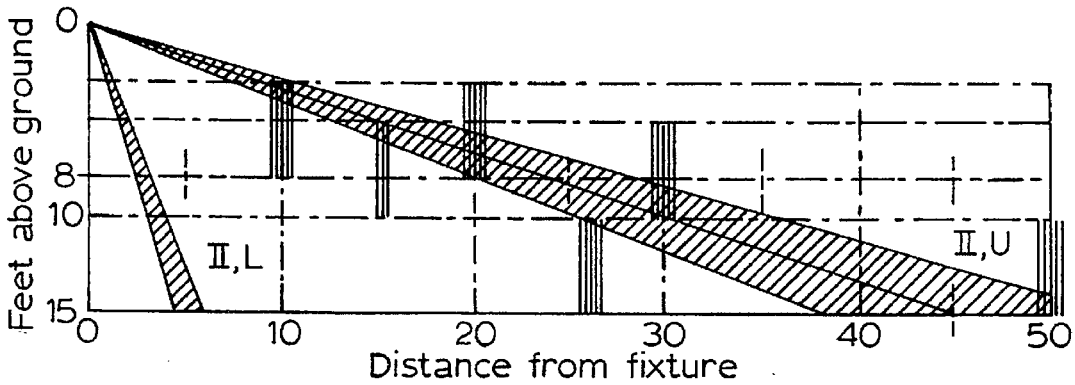
FIG. 10 is a schematic diagram of a possible vertical detection pattern of the upper (U) and lower (L) zones of a second level (II) of lens segments.
Figure 11:
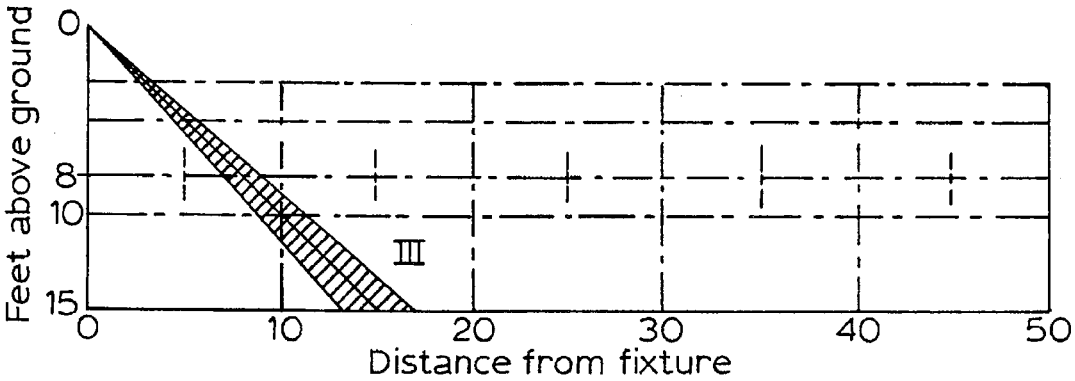
FIG. 11 is a schematic diagram of a possible vertical detection pattern of a third level (III) of lens segments.

FIGS. 9–11 are representations of the vertical area (shaded) where light fixture 20, in the embodiment shown in FIG. 8 which has five detection zones, detects motion when the light fixture is placed at various levels above the ground or floor. Examples shown are for placement at 8 or 10 feet from the ground (typically on a wall and under the eaves, respectively) and at 15 feet from the ground (not shown in FIG. 9).

As shown in FIG. 9, the lens segments in the upper row of the first level (I,U) in this arrangement are mounted so that when light fixture 20 is mounted under the eaves ten feet above the ground, the detecting zone from the light segments in the first level is targeted to detect the presence of someone about 35 feet from the fixture, but depending on the height of the person, and the proportion of person in the zone, will detect from about 27 to more than 50 feet from the fixture. When light fixture 20 is mounted on a wall at eight feet off the ground, the upper row of the first level of the fixture will detect someone about 20–50 feet from the fixture. The lens segments in the lower row of the first level (I, L) detect at a location about 2 feet out from the fixture.

The upper row of the second level (II, U) of segments in this arrangement of lens segments (FIG. 10) allows detection from about 10–25 feet from light fixture 20 when the fixture is mounted on a wall at eight feet. When the fixture is mounted under the eaves at 10 feet from the ground, the upper row of the second level allows detection about 15–30 feet from the fixture, and when the fixture is mounted under the eaves at a height of about 15 feet above the ground, the second level allows detection from about 27–50 feet from the fixture. The lower row of the second level (II, L) allows detection at about 3–5 feet from the fixture.

The third (central) level (III) of segments in this arrangement (FIG. 11) allows detection about 3–7 feet from light fixture 20 when mounted on the wall or under the eaves (at 8 feet height), at about 4–10 feet from the fixture when mounted under the eaves at 10 feet, and about 9–15 feet when mounted under the eaves at 15 feet in height.

During manufacture, the position of each lens segment on lens plate 28 is adjusted by means known in the art so that infrared radiation from a desired area directed at that lens segment when mounted on the lens plate 28 is focused by the lens segment so that it is detected by the detector. Thus, infrared radiation from the zone of detection shown in shading in FIGS. 9–11 is focused at the center of the respective lens segment on to the detector, as shown schematically in FIG. 12.

Figure 13:
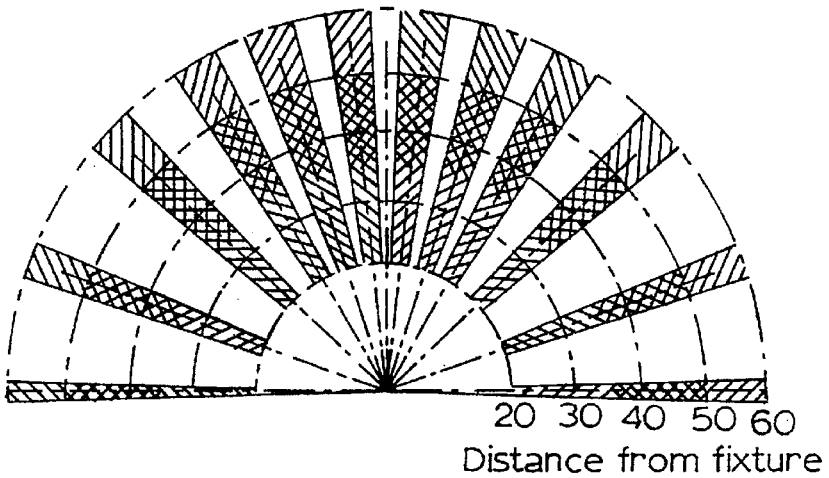
FIG. 13 is a schematic diagram of a possible horizontal detection pattern of a first level of lens segments.

As can be seen from FIG. 8, lens segments in each particular level are offset from the lens segments in the levels above and below the particular level to maximize the viewing area for detecting motion in a horizontal plane around a light fixture 20. FIG. 13 shows a horizontal view of the first level detection showing the pattern of coverage in the preferred embodiment of mounting of the lens segments. Although not shown, the second level pattern in this preferred embodiment would be offset from the pattern shown in FIG. 12 due to the offset lens segments in the two levels.

If it is desired to have an asymmetric view around light fixture 20, the number of levels, and the location of Fresnel lenses in each level may be individually adjusted, using calculations and knowledge of Fresnel lens manufacture, based on the lens dimensions and material, location of detector, the desired angle of view, and the like, as is known to those skilled in the art. Thus, for an area where there is a particularly unique mounting location having a particular area of view needing intensive monitoring, the target areas of the lens segments may be more tightly grouped.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A light fixture activated by motion, comprising:

(a) a housing having:

(i) a base suitable for mounting said housing on either a vertical or horizontal surface;

(ii) a canopy integral with said base adapted for receiving and fixedly mounting within said canopy selected motion sensor light detection components associated with said fixture and being further adapted for receiving and fixedly mounting within an aperture formed in an outer surface of said canopy at least one other selected motion sensor lens related component associated with said fixture; and (iii) a centrally located mounting hole enabling said housing including said base and canopy to be rotatably positioned 360° around said mounting hole prior to being mounted in a selected rotated position on a selected said vertical or horizontal surface;

(b) a selected number of sockets mounted on and extending outwardly from said canopy for holding a corresponding number of illumination sources operatively associated with said fixture; and (c) a selected number of fixedly positioned motion sensor components each comprising:

(i) a lens plate mounted within an aperture formed on an outer surface of said canopy and having a plurality of lens segments positioned thereon, said lens plate having a substantially wide angle of view up to about 180°; and (ii) detector means located within said canopy operatively associated with said lens plate.

2. The light fixture of claim 1, wherein said fixture has two said sockets for holding two said illumination sources.

3. The light fixture of claim 1, wherein said fixture has two said fixedly positioned motion sensor components.

4. The light fixture of claim 1, wherein said lens segments are positioned on said lens plate in a plurality of rows.

5. The light fixture of claim 4, wherein said plurality of rows comprise a central row and four rows having curvature, with two of said rows having curvature being on each side of said central row.

6. The light fixture of claim 1, wherein said base is planar and said lens plate has a face the plane of which, when said lens plate is mounted on said canopy and is viewed from the side, is angled at substantially 45° to plane of said base.

7. The light fixture of claim 1, wherein said lens segments each comprise a Fresnel lens.

8. The light fixture of claim 1, wherein said motion sensor component includes a lens plate holder mounted in said aperture and said lens plate is removeably mounted in said holder.

9. A light fixture as claimed in claim 1 wherein said fixture includes two adjustably positionable said sockets and two fixedly positioned said motion sensor components including two said lens plates, said canopy includes a central portion on opposite side surfaces of which said sockets are mounted and on end surfaces of which said lens plates are mounted wherein said fixture when utilizing the combined effects of said pair of lens plates provides a substantially 360° angle of view.

10. A light fixture as claimed in claim 1 wherein said lens plate is curved.

11. A light fixture activated by motion, comprising:

(a) a housing having:

(i) a base suitable for mounting said housing on either a vertical or horizontal surface; and (ii) a canopy integral with said base adapted for enclosing selected motion sensor components associated with said fixture and mounting on an outer surface of said canopy other selected said components;

(b) two sockets mounted on and extending outwardly from said canopy for holding corresponding two illumination sources associated with said fixture;

(c) two fixedly positioned motion sensors components each comprising:

(i) a lens plate mounted within an aperture formed on an outer surface of said canopy and having a plurality of lens segments positioned thereon, said lens plate having a substantially wide angle of view up to about 180°; and (ii) detector means located within said canopy operatively associated with said lens plate; and (d) said canopy includes a central portion on opposite side surfaces of which said sockets are mounted and on end surfaces of which said lens plates are mounted wherein said fixture when utilizing the combined of effects of said pair of lens plates provides a substantially 360° angle of view.

12. A light fixture as claimed in claim 11 wherein said housing comprises a centrally located mounting hole enabling said housing including said base and canopy to be rotatably positioned 360° around said mounting hole prior to being mounted in a selected rotated position on a selected said vertical or horizontal surface.

13. A light fixture as claimed in claim 11 wherein each said lens plate is curved.

* * * * *